US009133830B2

(12) United States Patent
Hansen et al.

(10) Patent No.: US 9,133,830 B2
(45) Date of Patent: Sep. 15, 2015

(54) FLUID DEVICE WITH FLEXIBLE RING

(75) Inventors: Lowell Dean Hansen, Brandon, MS (US); Phillip Wayne Galloway, Madison, MS (US); John Lawrence Walker, Madison, MS (US); August Nathan Johnson, Longmont, CO (US)

(73) Assignee: Eaton Corporation, Cleveland, OH (US)

( * ) Notice: Subject to any disclaimer, the term of this patent is extended or adjusted under 35 U.S.C. 154(b) by 1112 days.

(21) Appl. No.: 13/126,400

(22) PCT Filed: Oct. 30, 2009

(86) PCT No.: PCT/US2009/062711

§ 371 (c)(1),
(2), (4) Date: Jul. 18, 2011

(87) PCT Pub. No.: WO2010/051420

PCT Pub. Date: May 6, 2010

(65) Prior Publication Data

US 2011/0268596 A1 Nov. 3, 2011

Related U.S. Application Data

(60) Provisional application No. 61/110,098, filed on Oct. 31, 2008, provisional application No. 61/146,104, filed on Jan. 21, 2009.

(51) Int. Cl.
*F01C 20/18* (2006.01)
*F04B 1/107* (2006.01)
(Continued)

(52) U.S. Cl.
CPC ..... *F04B 1/107* (2013.01); *F04B 1/1071* (2013.01); *F04B 49/125* (2013.01); *F04C 2/3445* (2013.01); *F04C 5/00* (2013.01); *F04C 14/20* (2013.01)

(58) Field of Classification Search
CPC ..... F04B 1/107; F04B 1/1071; F04B 49/125; F04C 2/3445; F04C 5/00; F04C 49/125
USPC ..... 92/12.1, 13.2, 58, 72; 91/497, 491, 494
See application file for complete search history.

(56) References Cited

U.S. PATENT DOCUMENTS 2,273,034 A 2/1942 Grey
2,467,121 A * 4/1949 Ferris ..... 29/888.025
(Continued)

FOREIGN PATENT DOCUMENTS

AT 179 971 B 10/1954
GB 384 410 A 12/1932
(Continued)

*Primary Examiner* — Dwayne J White
*Assistant Examiner* — Logan Kraft
(74) *Attorney, Agent, or Firm* — Merchant & Gould P.C.

(57) ABSTRACT

A fluid device includes a housing defining a fluid inlet and a fluid outlet. A variable displacement assembly is in fluid communication with the fluid inlet and the fluid outlet. The variable displacement assembly includes a rotor assembly, a flexible ring, and a plurality of ring supports. The rotor assembly includes a rotor having a plurality of reciprocating members. The flexible ring is disposed about the rotor assembly. The flexible ring includes an inner surface, which is adapted for engagement with the plurality of reciprocating members, and an outer surface. The plurality of ring supports is disposed about the flexible ring. Each of the plurality of ring supports includes a support portion and a pivot portion about which the ring support selectively pivots. The support portion is adapted for engagement with the outer surface of the flexible ring.

28 Claims, 14 Drawing Sheets

(51) Int. Cl.

| | |
|---|---|
| ***F04B 49/12*** | (2006.01) |
| ***F04C 2/344*** | (2006.01) |
| ***F04C 5/00*** | (2006.01) |
| ***F04C 14/20*** | (2006.01) |

(56) References Cited

U.S. PATENT DOCUMENTS

| | | | | |
|---|---|---|---|---|
| 2,608,934 | A * | 9/1952 | Ferris | 417/272 |
| 2,842,064 | A * | 7/1958 | Wahlmark | 418/31 |
| 2,970,748 | A | 2/1961 | Bendall | |
| 3,153,984 | A | 10/1964 | Fikse | |
| 3,166,017 | A | 1/1965 | Mamo | |
| 3,604,823 | A * | 9/1971 | Thomas | 418/26 |
| 3,749,531 | A | 7/1973 | Walker et al. | |
| 3,807,912 | A | 4/1974 | Keller | |
| 3,898,021 | A | 8/1975 | Barnéoud-Arnoulet | |
| 5,806,560 | A | 9/1998 | Brown et al. | |
| 5,956,953 | A | 9/1999 | Folsom et al. | |
| 6,022,201 | A | 2/2000 | Kasmer | |
| 6,212,994 | B1 | 4/2001 | Estrabrooks | |
| 6,283,736 | B1 | 9/2001 | Baptista et al. | |
| 6,527,525 | B2 | 3/2003 | Kasmer | |
| 6,536,217 | B2 * | 3/2003 | Lipinski et al. | 60/772 |
| 6,612,117 | B2 * | 9/2003 | Kasmer | 62/6 |
| 6,666,670 | B1 * | 12/2003 | Hartman et al. | 418/133 |
| 7,108,493 | B2 | 9/2006 | Clements et al. | |
| 7,247,008 | B2 | 7/2007 | Clements et al. | |
| 7,491,043 | B2 | 2/2009 | Clements et al. | |

FOREIGN PATENT DOCUMENTS

| | | | |
|---|---|---|---|
| GB | 524 199 | A | 8/1940 |
| GB | 545 323 | A | 5/1942 |
| WO | WO 98/35147 | A1 | 8/1998 |

* cited by examiner

FLUID DEVICE WITH FLEXIBLE RING

CROSS-REFERENCE TO RELATED APPLICATIONS

This application is a U.S. National Stage Application of PCT/US2009/062711, filed on 30 Oct. 2009 in the name of Lowell Dean Hansen, a citizen of the U.S., Phillip Wayne Galloway, a citizen of the U.S. John Lawrence Walker, a citizen of the U.S., and Nathan August Johnson, a citizen of the U.S., and claims priority to U.S. Provisional Patent Application Ser. No. 61/110,098 filed on 31 Oct. 2008 and U.S. Provisional Patent Application Ser. No. 61/146,104 filed on 21 Jan. 2009 and which applications are incorporated herein by reference. To the extent appropriate, a claim of priority is made to each of the above disclosed applications.

BACKGROUND

Fluid devices, such as fluid pumps, typically include a displacement assembly (e.g., a rotor assembly, cylinder barrel assembly, gerotor assembly, etc.) that displaces a certain volume of fluid as the displacement assembly rotates about a rotational axis. Of these fluid devices, many are of the types that include rotors with fluid pumping elements that reciprocate radially relative to a rotational axis (e.g., vane type, radial piston type, cam-lobe type, etc.). These fluid pumping elements act against a cam surface. As the rotor rotates about the rotational axis, the fluid pumping elements extend and retract in response to the rise and fall of the cam surface. This extension and retraction of the fluid pumping elements results in fluid being pumped through the fluid device.

These types of fluid devices can be fixed displacement devices or variable displacement devices. In the variable displacement devices, the displacement is typically varied by offsetting the rotor relative to the cam surface. Such an offset can increase or decrease the distance traveled by the fluid pumping elements thereby increasing or decreasing the volume of fluid displaced through the fluid device.

While these types of fluid devices work effectively in many different applications, some applications require variable fluid devices having higher efficiency ratings. One type of fluid device that is credited with higher efficiency ratings uses a flexible band that surrounds the rotor and the pumping elements. The pumping elements act against the flexible band to pump fluid. In order to change the displacement of the fluid device, the shape of the flexible band is changed, displaced or deformed. However, as a result of the deformed shape of the flexible band and as a result of the pumping elements acting against the flexible band, stresses develop within the flexible band. Often these stresses can decrease the life of the flexible band.

SUMMARY

An aspect of the present disclosure relates to a variable displacement assembly having a rotor assembly disposed in a flexible ring. A plurality of ring supports are disposed about the flexible ring to support outer surface of the flexible ring as the flexible ring is deflected to through a range of displacement positions.

Another aspect of the present disclosure relates to a variable displacement assembly for use in a fluid device. The variable displacement assembly includes a flexible ring having an inner surface and an outer surface and a plurality of ring supports disposed about and surrounding the outer surface of the flexible ring. Each of the plurality of ring supports includes a support portion, which is adapted for engagement with the outer surface of the flexible ring, and a pivot portion about which the ring support selectively pivots. The pivoting of the ring support about the pivot portion moves the flexible ring between a relaxed position and a displaced position.

Another aspect of the present disclosure relates to a fluid device. The fluid device includes a housing defining a fluid inlet and a fluid outlet. A variable displacement assembly is in fluid communication with the fluid inlet and the fluid outlet. The variable displacement assembly includes a rotor assembly, a flexible ring, and a plurality of ring supports. The rotor assembly includes a rotor having a plurality of reciprocating members. The flexible ring is disposed about the rotor assembly. The flexible ring includes an inner surface, which is adapted for engagement with the plurality of reciprocating members, and an outer surface. The plurality of ring supports is disposed about the flexible ring. Each of the plurality of ring supports includes a support portion and a pivot portion about which the ring support selectively pivots. The support portion is adapted for engagement with the outer surface of the flexible ring.

Another aspect of the present disclosure relates to a fluid device. The fluid device includes a housing and a variable displacement assembly. The housing includes a fluid inlet and a fluid outlet. The variable displacement assembly is in fluid communication with the fluid inlet and the fluid outlet and includes a rotor assembly, an inner flexible ring, an outer flexible ring, and a plurality of ring supports. The rotor assembly includes a rotor and a plurality of reciprocating members that are adapted for radial reciprocation in openings in the rotor. The inner flexible ring is disposed about the rotor assembly and includes an inner surface and an outer surface. The inner surface is adapted for engagement with the reciprocating members. The outer flexible ring includes an inner surface and an outer surface. The inner surface of the outer flexible ring is adapted for engagement with the outer surface of the inner flexible ring. The plurality of ring supports is disposed about the outer flexible ring. Each of the ring supports includes a support portion and a pivot portion about which the ring support selectively pivots. The support portion is adapted for engagement with the outer surface of the outer flexible ring.

Another aspect of the present disclosure relates to a method for evacuating a fuel manifold of an engine fuel system. The method includes providing a bidirectional fluid device having a variable displacement assembly that is adapted to transfer fuel from a fuel source to a fuel manifold in a first direction. The method further includes actuating the variable displacement assembly such that the fuel is transferred through the fluid device in a second direction that is opposite from the first direction. In the second direction, the fuel is transferred from the fuel manifold to the fuel source.

A variety of additional aspects will be set forth in the description that follows. These aspects can relate to individual features and to combinations of features. It is to be understood that both the foregoing general description and the following detailed description are exemplary and explanatory only and are not restrictive of the broad concepts upon which the embodiments disclosed herein are based.

DRAWINGS

DETAILED DESCRIPTION

Reference will now be made in detail to the exemplary aspects of the present disclosure that are illustrated in the accompanying drawings. Wherever possible, the same reference numbers will be used throughout the drawings to refer to the same or like structure.

Figure 1:
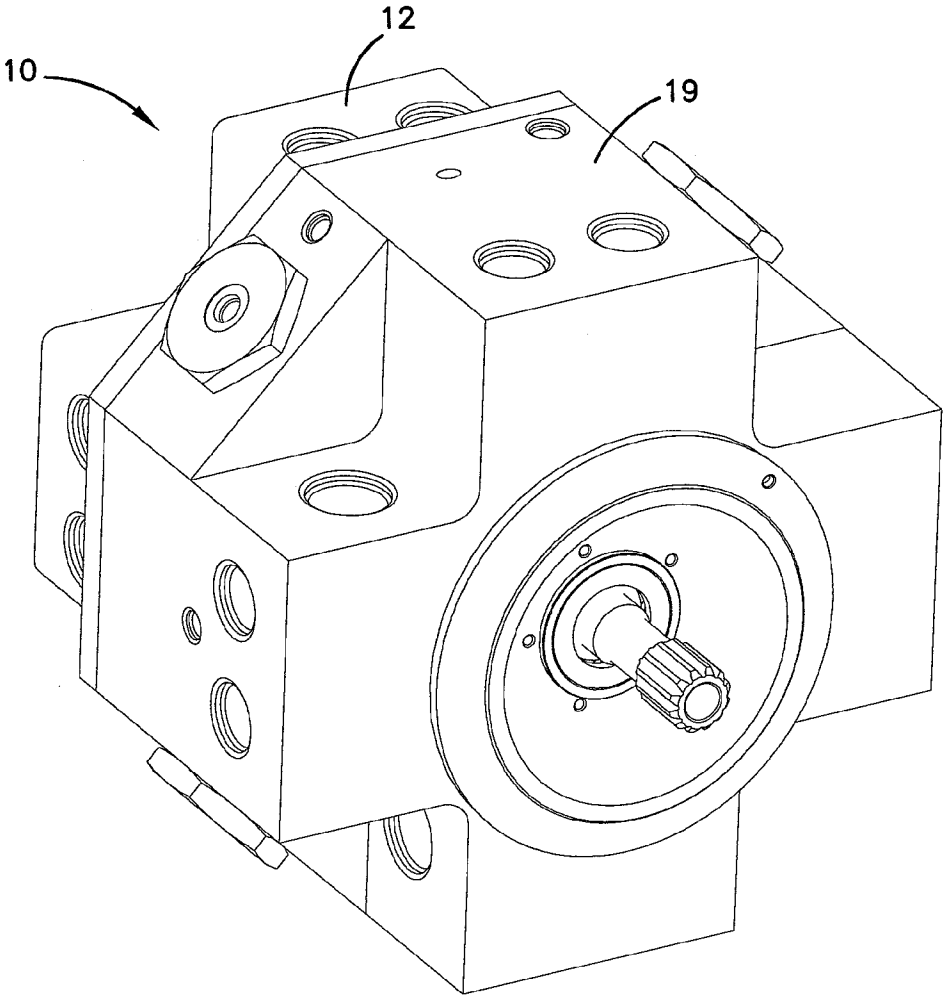
FIG. 1 is a perspective view of a fluid device having features that are examples of aspects in accordance with the principles of the present disclosure.

Referring now to FIG. 1, a fluid device, generally designated 10, is shown. In the depicted embodiment of FIG. 1, the fluid device 10 is a radial piston type fluid device. It will be understood, however, that the scope of the present disclosure is not limited to the fluid device 10 being a radial piston type fluid device as the fluid device 10 could also be a vane type, cam lobe type, or other type of fluid device. While the fluid device 10 will be described as a pump, it will be understood that the scope of the present disclosure is not limited to the fluid device 10 functioning as a pump as the fluid device 10 could alternatively function as a motor.

Figure 2:
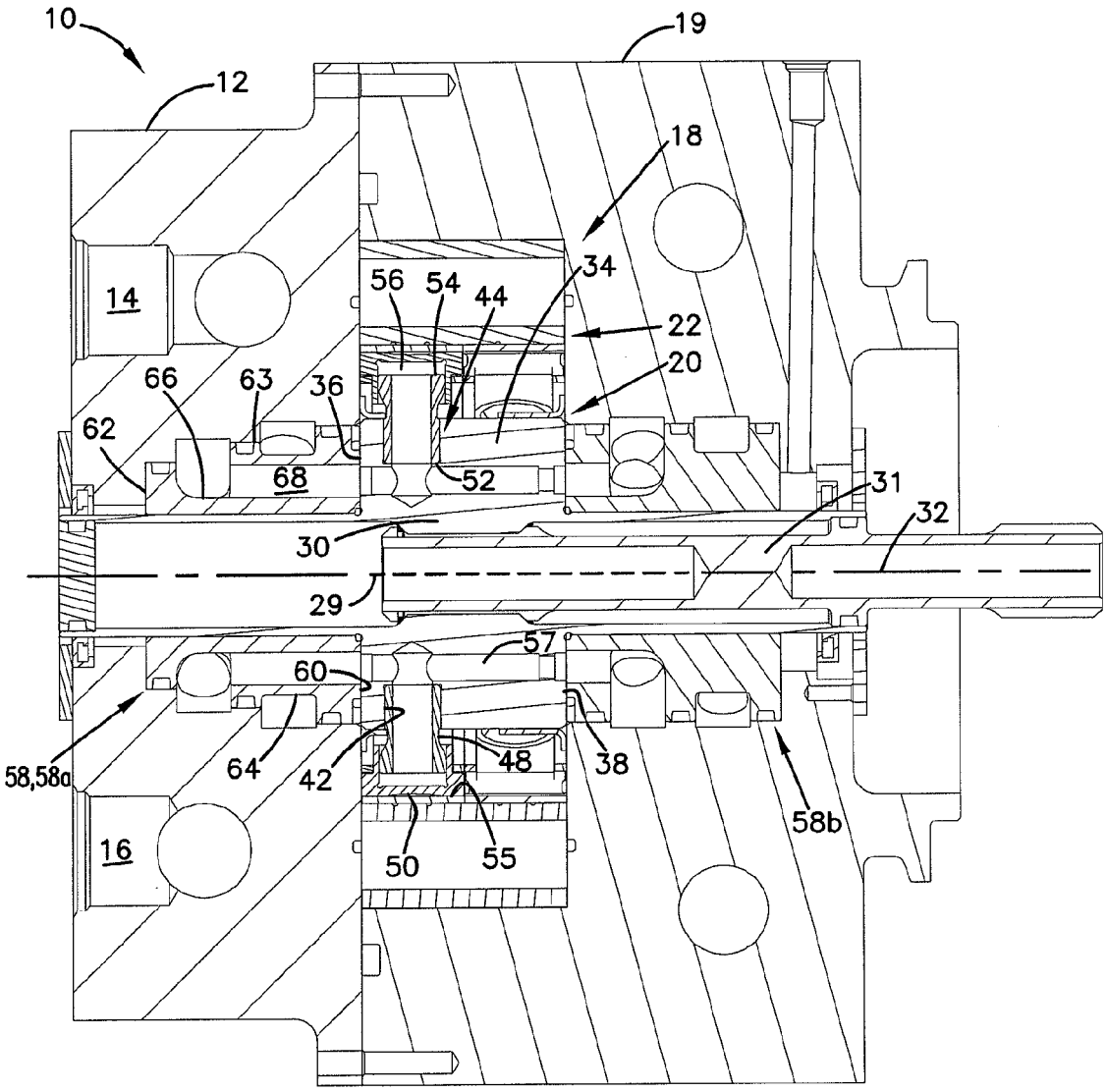
FIG. 2 is a cross-sectional view of the fluid device of FIG. 1.

Referring now to FIGS. 1 and 2, the fluid device 10 includes a housing, generally designated 12, defining a fluid inlet 14 and a fluid outlet 16. In the subject embodiment, the housing 12 of the fluid device 10 includes a cover 17 that is engaged with a variable displacement assembly, generally designated 18. The variable displacement assembly 18 is in fluid communication with the fluid inlet 14 and the fluid outlet 16. In the subject embodiment, the variable displacement assembly 18 is disposed within an outer ring 19 that is in tight engagement with the housing 12.

Figure 3:
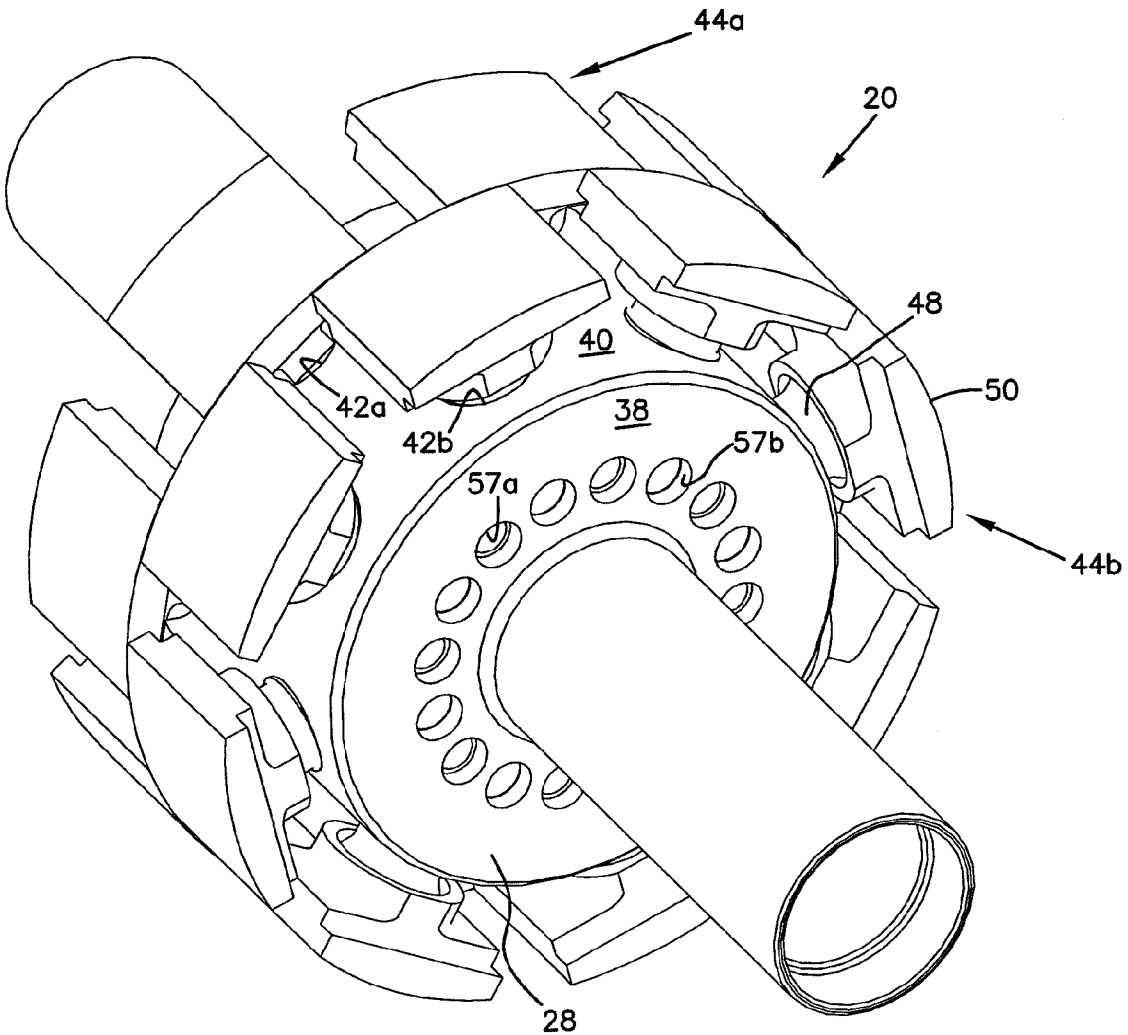
FIG. 3 is an isometric view of a rotor assembly suitable for use in the fluid device of FIG. 1.

Referring now to FIGS. 2 and 3, the variable displacement assembly 18 includes a rotor assembly, generally designated 20, and a flexible ring assembly, generally designated 22. The rotor assembly 20 includes a rotor, generally designated 28, that is adapted for rotation about a rotating axis 29 of the rotor 28. In the subject embodiment, the rotor 28 includes an internal spline 30 that is adapted for engagement with a main drive 31. In one embodiment, the rotor assembly 20 rotates about the rotating axis 29 in response to rotation of the main drive 31. As the rotor assembly 20 rotates, the fluid device 10 transfers or pumps fluid from one location (e.g., a reservoir, etc.) to another location (e.g., an actuator, etc.). In the subject embodiment, the rotating axis 29 of the rotor 28 is generally aligned with a longitudinal central axis 32 of the fluid device 10.

The rotor 28 includes a body 34 having a first face 36, which is generally perpendicular to the rotating axis 29, an oppositely disposed second face 38 (best shown in FIG. 3), which is generally parallel to the first face 36, and an outer surface 40 disposed between the first and second faces 36, 38. In the subject embodiment, the rotor 28 is cylindrical in shape. Therefore, in the subject embodiment, the outer surface 40 is an outer circumferential surface.

The outer surface 40 defines a plurality of bores 42 disposed about the rotor 28. The bores 42 radially extend from the outer surface 40 toward the rotating axis 29 of the rotor 28. In the subject embodiment, the outer surface 40 defines a first plurality of bores 42*a* and a second plurality of bores 42*b*. As best shown in FIG. 3, the first plurality of bores 42*a* is axially and rotationally offset from the second plurality of bores 42*b*. The first plurality of bores 42*a* is adapted to receive a first plurality of radially reciprocating members 44*a* while the second plurality of bores 42*a* is adapted to receive a second plurality of radially reciprocating members 44*b*.

In the subject embodiment, the first and second plurality of bores 42*a*, 42*b* are substantially similar. In addition, the first and second plurality of radially reciprocating members 44*a*, 44*b* are substantially similar. Therefore, for ease of description purposes, the first and second plurality of bores 42*a*, 42*b* will be collectively referred to as bores 42 while the first and second plurality of radially reciprocating members 44*a*, 44*b* will be collectively referred to as reciprocating members 44.

In one embodiment, the reciprocating members 44 are vanes of the type suitable for use in a vane type fluid device. In the subject embodiment, the reciprocating members 44 are radial pistons suitable for use in a radial piston type fluid device. The radial pistons include piston members 48 and piston shoes 50 that reciprocate relative to the piston members 48. The piston members 48 include first axial end portions 52 and second axial end portions 54. The first axial end portions 52 are adapted for insertion in the bores 42. The second axial end portions 54 are adapted for insertion in a cavity 53 of the piston shoes 50.

The piston shoes 50 of the reciprocating members 44 are adapted for engagement with a cam surface 55 of the flexible ring assembly 22. As the rotor assembly 20 rotates about the rotating axis 29, the piston shoes 50 of the reciprocating members 44 reciprocate relative to the piston members 48 in response to engagement with the cam surface 55 of the flexible ring assembly 22. As the piston shoes 50 reciprocate relative to the piston members 48, volume chambers 56, which are cooperatively defined by the cavities 53 of the piston shoes 50 and the second axial end portions 54 of the piston members 48, expand and contract.

The variable displacement assembly 18 includes at least one inlet region at which fluid is drawn into the variable displacement assembly 18 and at least one outlet region at which fluid is expelled from the variable displacement region. In the inlet region of the variable displacement assembly 18, a distance between the cam surface 55 of the flexible ring assembly 22 and the rotor 28 increases as the rotor assembly 20 rotates. As the distance between the cam surface 55 and the rotor 28 increases, the piston shoes 50 extend outwardly from the second axial end portions 54 of the piston members 48 causing the corresponding volume chambers 56 to expand and draw fluid in from the fluid inlet 14.

In the outlet region of the variable displacement assembly 18, the distance between the cam surface 55 and the rotor 28 decreases as the rotor assembly 20 rotates. As the distance between the cam surface 55 and the rotor 28 decreases, the piston shoes 50 retract on the second axial end portions 54 of the piston members 44 causing the corresponding volume chambers 56 to contract and expel fluid out the fluid outlet 16. In the subject embodiment, the variable displacement assembly 18 includes two inlet regions and two outlet regions.

In one embodiment, one of the first and second faces 36, 38 of the rotor 28 includes a plurality of fluid passages 57. The fluid passages 57 of the rotor 28 are in fluid communication with the plurality of volume chambers 56 in the rotor assembly 20. In the subject embodiment, the first and second faces 36, 38 define a first plurality of fluid passages 57*a* that are in fluid communication with the first plurality of bores 42*a* and a second plurality of fluid passages 57*b* that are in fluid communication with the second plurality of bores 42*b*.

In one embodiment, the rotor 28 is in commutating fluid communication with a pintle 58. In the subject embodiment, the rotor 28 is in commutating fluid communication with a first pintle 58*a* and a second pintle 58*b*. The pintle 58 is non-rotatably disposed in the housing 12 and is in fluid communication with the fluid inlet 14 and the fluid outlet 16 of the fluid device 10. In the subject embodiment, each of the first and second pintles 58*a*, 58*b* includes a first axial end 60, an opposite second axial end 62 and an outer circumferential surface 63.

The outer circumferential surface 63 defines a first groove 64 that is in fluid communication with the fluid inlet 14 and a second groove 66 that is in fluid communication with the fluid outlet 16. The first axial end 60 of the pintle 58 defines a plurality of inlet fluid passageways (not shown) in fluid communication with the first groove 64 and a plurality of outlet fluid passageways 68 in fluid communication with the second groove 66.

The first axial end 60 of the first pintle 58*a* is adapted for sealing engagement with the first face 36 of the rotor 28 while the first axial end 60 of the second pintle 58*b* is adapted for sealing engagement with the second face 38 of the rotor 28. As the rotor 28 rotates about the rotating axis 29, the inlet fluid passageways and the outlet fluid passageways 68 of the first and second pintles 58*a*, 58*b* are in commutating fluid communication with the first and second plurality of fluid passages 57*a*, 57*b*, respectively, of the rotor assembly 20 such that fluid from the inlet fluid passageways of the first and second pintles 58*a*, 58*b* are drawn into the expanding volume chambers 56 while fluid from the contracting volume chambers 56 is expelled through the outlet fluid passageways 68.

The first and second grooves 64, 66 are configured such that fluid in the first and second grooves 64, 66 biases the pintle 58 toward the rotor assembly 20. In the subject embodiment, and by way of example only, fluid in the first and second grooves 64, 66 of the first pintle 58*a* biases the first pintle 58*a* toward the first face 36 of the rotor 28 while fluid in the first and second grooves 64, 66 of the second pintle 58*b* biases the second pintle 58*b* toward the second face 38 of the rotor 28. This biasing of the pintles 58 toward the rotor 28 is potentially advantageous as it restricts the axial movement of the rotor 28.

Figure 4:
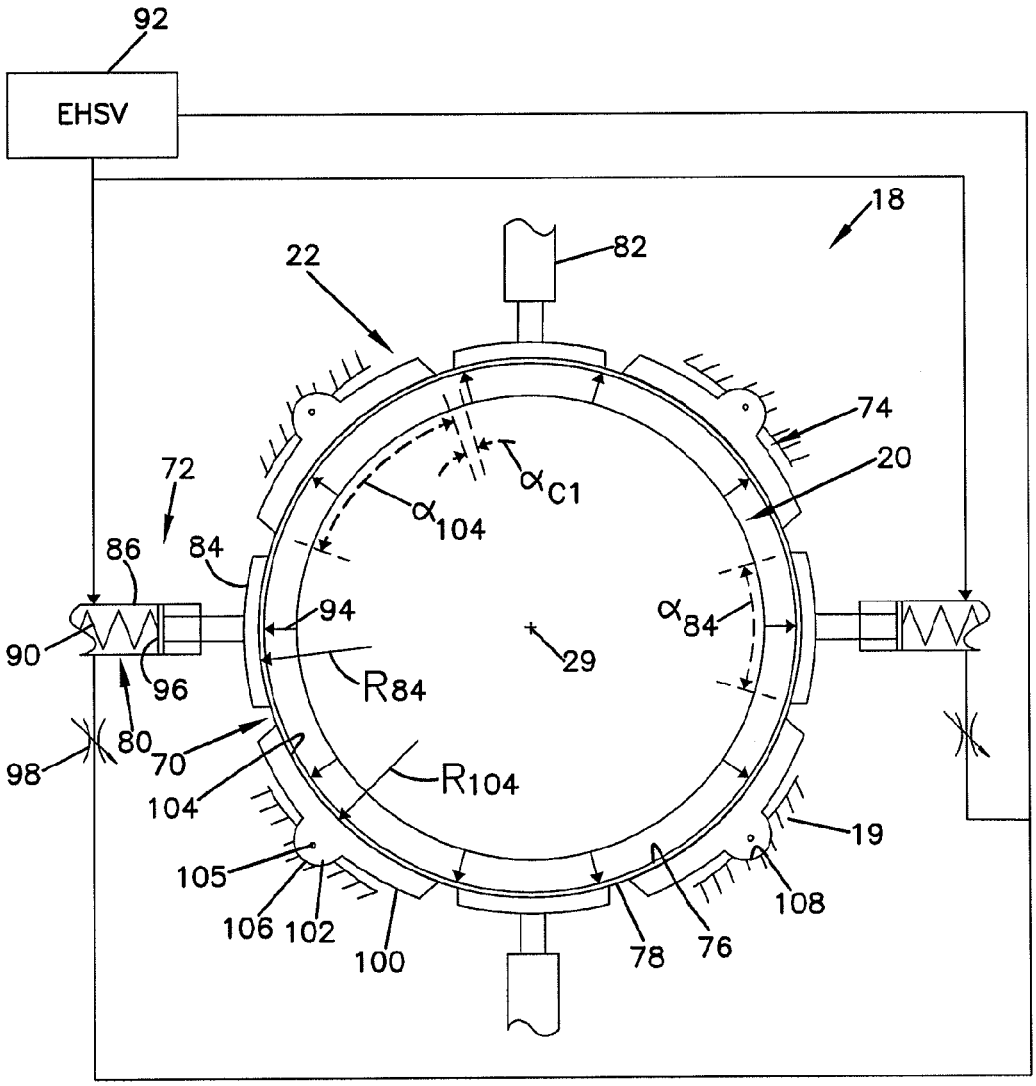
FIG. 4 is a schematic representation of a variable displacement assembly suitable for use in the fluid device of FIG. 1 shown in a relaxed position.
Figure 5:
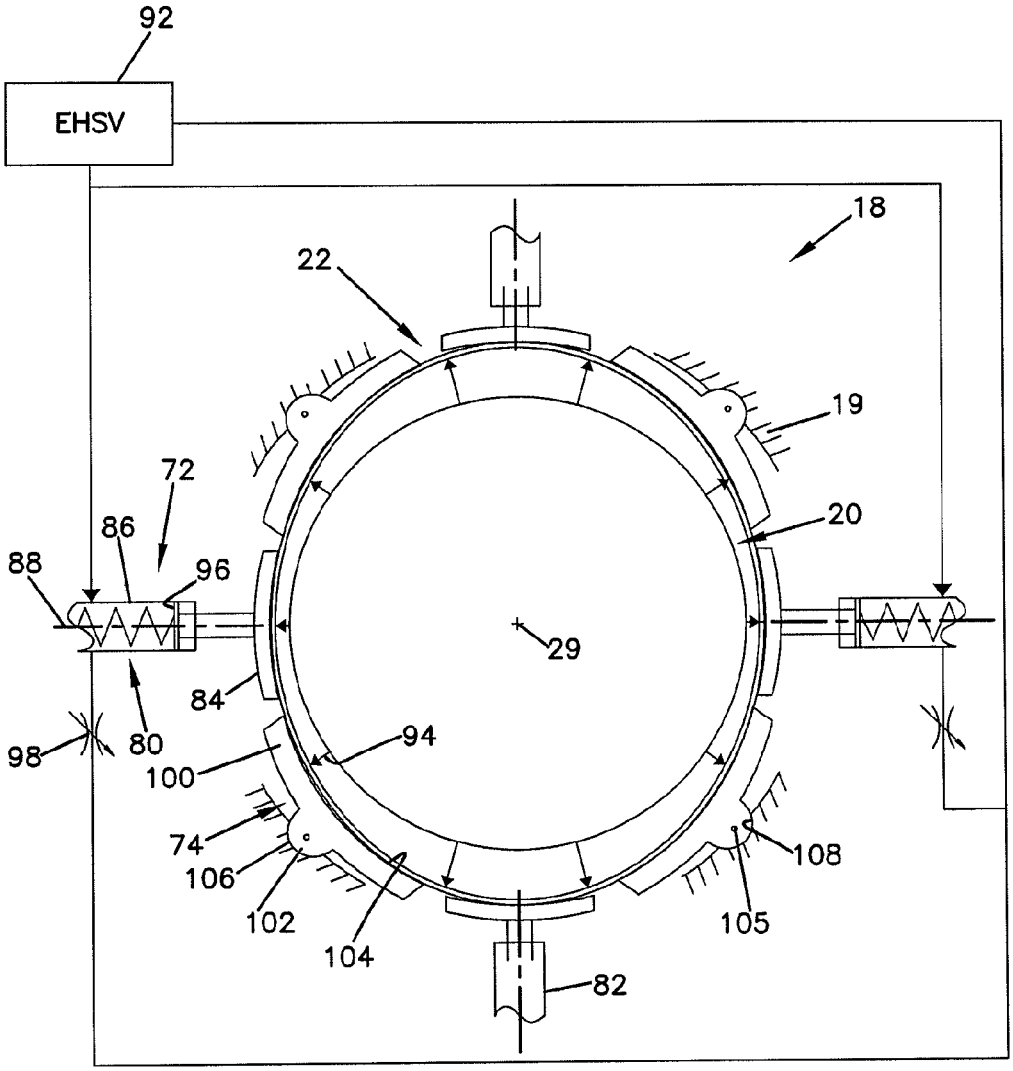
FIG. 5 is a schematic representation of the variable displacement assembly of FIG. 4 shown in a maximum displacement position.

Referring now to FIGS. 3-5, the flexible ring assembly 22 of the variable displacement assembly 18 is disposed about the rotor assembly 20. The flexible ring assembly 22 includes a flexible ring 70, a plurality of control pistons 72, and a plurality of ring supports 74.

In the subject embodiment, the flexible ring 70 is a thin metal ring that surrounds the rotor assembly 20. In one embodiment, and by way of example only, the flexible ring 70 is made from a material such as 6440 grade steel and is less than about 0.06 inches thick.

The shape of the flexible ring 70 affects the displacement of the fluid device 10, where displacement is measured by the volume of fluid that passes through the fluid device 10 with each rotation of the rotor assembly 20. In a relaxed position (i.e., a neutral position, which is shown in FIG. 4), the flexible ring 70 is generally circular in shape (i.e., generally constant radius) and includes an axis that is generally aligned with the rotating axis 29 of the rotor assembly 20. In a maximum displacement position (shown in FIG. 5), the flexible ring 70 is generally elliptical in shape.

The flexible ring 70 includes an inner surface 76 and an outer surface 78. In the subject embodiment, the inner surface 76 of the flexible ring 70 is the cam surface 55 of the variable displacement assembly 18. Therefore, the inner surface 76 is adapted for engagement with the reciprocating members 44 of the rotor assembly 20. In the subject embodiment, the inner surface 76 of the flexible ring 70 is adapted for engagement with the piston shoes 50 of the reciprocating members 44.

In one embodiment, the frictional forces between the inner surface 76 of the flexible ring 70 and the reciprocating members 44 cause the flexible ring 70 to rotate about the rotating axis 29. In the subject embodiment, the flexible ring 70 rotates about the rotating axis 29 of the rotor assembly 20 at substantially the same speed as the rotor assembly 20.

With the flexible ring 70 in the relaxed position, the reciprocating members 44 of the rotor assembly 20 generally do not reciprocate within the bores 42 since the distance between the outer surface 40 of the rotor 28 and the cam surface 55 is generally constant in the relaxed position. As the reciprocating members 44 of the rotor assembly 20 do not reciprocate within the bores 42 in the relaxed position, the volume chambers 56 of the rotor assembly 20 neither expand nor contract. As a result, the displacement of the fluid device 10 is about zero cubic inches per revolution in the relaxed position.

As the shape of the flexible ring 70 changes from the generally circular shape to a more elliptical shape, the displacement of the fluid device 10 increases. As displacement increases, the amount of reciprocation of the reciprocating members 44 in the bores 42 of the rotor 28 increases, thereby causing an increase in the expansion and contraction of the volume chambers 56. As the expansion and contraction of the volume chambers 56 increases, the volume of fluid that passes through the fluid device 10 per revolution also increases.

The shape of the flexible ring 70 is controlled in part by the plurality of control pistons 72. The plurality of control pistons 72 is disposed around the outer surface 78 of the flexible ring 70. In the subject embodiment, there are four control pistons 72 disposed about the outer surface 78 of the flexible ring 70 in about 90 degree increments. In the depicted embodiment of FIG. 4, the control pistons 72 act directly against the outer surface 78 of the flexible ring 70.

Referring now to FIGS. 4 and 5, schematic representations of the variable displacement assembly 18 are shown. In a fluid device 10 that is unidirectional, or capable of pumping fluid in only one direction (e.g., pumping fluid from a reservoir), the plurality of control pistons 72 includes a plurality of displacement pistons 80 and a plurality of reaction pistons 82. In a fluid device 10 that is bidirectional, or capable of pumping fluid in two directions (e.g., pumping fluid from a reservoir and/or pumping fluid to a reservoir), the plurality of control pistons 72 may only include the plurality of displacement pistons 80. In the subject embodiment, there are four control pistons 72. In the unidirectional fluid device 10, two of the control pistons 72 are displacement pistons 80 while two of the control pistons are reaction pistons 82. In the bidirectional fluid device 10, the four control pistons are displacement pistons 80. In the following description of FIGS. 4 and 5, the fluid device 10 will be described as a unidirectional fluid device 10. It will be understood, however, that the scope of the present disclosure is not limited to the fluid device 10 being unidirectional.

The displacement pistons 80 are oppositely disposed from each other about the outer surface 78 of the flexible ring 70. In the depicted embodiment of FIG. 4, the displacement pistons 80 are about 180 degrees apart from each other.

The reaction pistons 82 are also disposed oppositely from each other about the outer surface 78 of the flexible ring 70. In the depicted embodiment of FIG. 4, the reaction pistons 82 are about 180 degrees apart from each other. The displacement pistons 80 and the reaction pistons 82 are disposed about the outer surface 78 of the flexible ring 70 in an alternating arrangement such that each reaction piston 82 is disposed between a pair of displacement pistons 80. In the depicted embodiment, the reaction pistons 82 are disposed about 90 degrees from the adjacent displacement pistons 80.

In the subject embodiment, each of the plurality of control pistons 72 includes a first end portion 84 and a second end portion 86. The first end portion 84 acts against the outer surface 78 of the flexible ring 70. In the subject embodiment, the first end portion 84 acts directly against the outer surface 78 of the flexible ring 70.

Each of the control pistons 72 extends and retracts along a longitudinal axis 88 (shown in FIG. 5) that extends radially toward the rotating axis 29 (shown as a "+" in FIG. 4) of the rotor assembly 20. In the depicted embodiment, each of the displacement pistons 80 is biased by a spring 90 toward the extended position. In this embodiment, the variable displacement assembly 18 is biased to the maximum displacement position.

Fluid is selectively supplied to the second end portion 86 of the displacement piston 80 by an electro-hydraulic servo valve 92 (EHSV). In the subject embodiment, the second end portions 86 of the displacement pistons 80 are generally cylindrical in shape. Diameters of the second end portions 86 of the displacement pistons 80 are sized to balance forces 94 (shown schematically as arrows in FIGS. 4 and 5) acting on the inner surface 76 of the flexible ring 70 by the reciprocating members 44. In one embodiment, and by way of example only, the outer diameters of the second end portions 86 of the displacement pistons 80 are larger in size than the outer diameters of the reciprocating members 44.

The pressure of the fluid supplied by the EHSV 92 acts on an end surface 96 of the displacement piston 80 such that the pressure of the fluid acting on the end surface 96 balances the forces 94 acting against the inner surface 76 of the flexible ring 70 by the reciprocating members 44 disposed in the rotor assembly 20. With the forces 94 of the reciprocating members 44 balanced by the pressure from the fluid supplied by the EHSV 92, the full biasing force of the spring 90 is transferred to the flexible ring 70 to change the shape of the flexible ring 70 thereby increasing the displacement of the variable displacement assembly 18.

In the subject embodiment, variable orifices 98 are in fluid communication with the second end portions 86 of the displacement pistons 80. The variable orifices 98 are selectively operable in a range of positions between fully open and fully closed. With the variable orifices 98 in a position that is at least partially open, the variable orifices 98 relieve a portion of the pressure of the fluid supplied by the EHSV 92 that acts against the end surfaces 96 of the displacement pistons 80. With the pressure of the fluid at least partially relieved, a portion of the biasing force of the spring 90 is used to balance the forces 94 acting against the inner surface 76 of the flexible ring 70. As a result, less spring force is available to displace the variable displacement assembly 18. Therefore, the displacement of the variable displacement assembly 18 is less with the variable orifices 98 in an at least partially open position than in a fully closed position.

The first end portions 84 of the control pistons 72 are generally arcuate in shape. In the subject embodiment, the arcuate shape of the first end portions 84 includes a radius $R_{84}$ that is about equal to the radius of the flexible ring 70 in the relaxed position. The arcuate shape of the first end portions 84 of the control pistons 72 extends an angle $\alpha_{84}$. In the subject embodiment, and by way of example only, the angle $\alpha_{84}$ is about equal to the 360 degrees divided by the number of reciprocating members 44 in the rotor assembly 20. For example, in the subject embodiment, as there are eight reciprocating members 44 in the rotor assembly 20, the arcuate shape of the first end portions 84 of the control pistons 72 extends an angle $\alpha_{84}$ that is about equal to 45 degrees.

Referring still to FIGS. 4 and 5, the plurality of ring supports 74 is disposed around the outer surface 78 of the flexible ring 70. In the depicted embodiment of FIGS. 4 and 5, each of the ring supports 74 is disposed between one of the displacement pistons 80 and one of the reaction pistons 82. In the subject embodiment, there are four ring supports 74. By way of example only, each ring support 74 is disposed at a location about the outer surface 78 of the flexible ring 70 that is about half the distance between the displacement piston 80 and the reaction piston 82. In the subject embodiment, the ring supports 74 are disposed about 45 degrees from the displacement pistons 80 and the reaction pistons 82.

Each of the plurality of ring supports 74 includes a support portion 100 and a pivot portion 102. In the subject embodiment, the support portion 100 includes an arcuate surface 104 that is adapted for engagement with the outer surface 78 of the flexible ring 70. The arcuate surface 104 includes a radius $R_{104}$ that is a similar in size to the radius of the flexible ring 70 in the relaxed position (shown schematically in FIG. 5). In one embodiment, the radius $R_{104}$ is greater than or equal to the radius of the flexible ring 70 in the relaxed position.

The arcuate surface 104 extends an angle $\alpha_{104}$. In the subject embodiment, the angle $\alpha_{104}$ is sized to be slightly less than the angle between the first end portions 84 of adjacent control pistons 72. This angle $\alpha_{104}$ is slightly smaller than the angle between adjacent control pistons 72 so that the ring supports 74 can pivot about the pivot portion 102 without interfering with the control pistons 72. In the subject embodiment, and by way of example only, there is a clearance angle $\alpha_{c1}$ of about 1 degree to about 12 degrees between the support portion 100 and one of the adjacent control pistons 72. In another embodiment, and by way of example only, the clearance angle $\alpha_{c1}$ is less than about 10 degrees, less than about 6 degrees, or less than about 4 degrees.

In the subject embodiment, the pivot portion 102 is disposed opposite the support portion 100. Each of the pivot portions 102 is adapted to provide for pivoting or rocking movement of the ring support 74. In the subject embodiment, each of the pivot portions 102 includes an axis 105 (shown schematically as a dot in FIGS. 4 and 5) about which the corresponding ring support 74 pivots. In one embodiment, the axis 105 is positioned on the arcuate surface 104. In the subject embodiment, the pivot portion 102 includes a convex surface 106. The convex surface 106 is adapted for engagement in a pocket 108 of a support structure such as the cover 17 or the outer ring 19 of the housing 12. The pocket 108 holds the pivot portion 102 of the ring support 74 in place. However, the pivot portion 102 is free to pivot within the pocket 108. As the pivot portion 102 pivots within the pocket 108, the convex surface 106 slides against a surface of the pocket 108.

The plurality of ring supports 74 supports at least a portion of the flexible ring 70 between adjacent control pistons 72. By providing support to at least a portion of the flexible ring 70 between adjacent control pistons 72, the plurality of ring supports 74 maintains the desired shape of the flexible ring 70 between adjacent control pistons 72.

Figure 6:
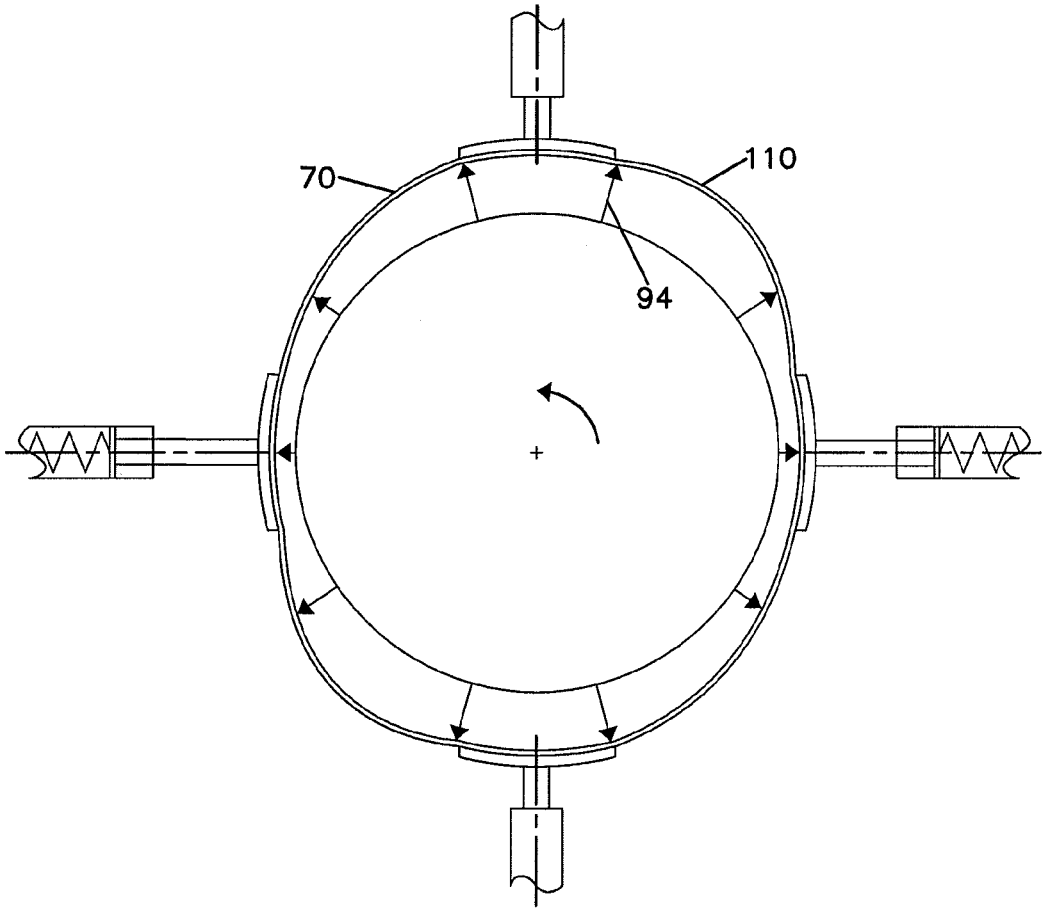
FIG. 6 is a schematic representation of a variable displacement assembly without ring supports.

Referring now to FIG. 6, the variable displacement assembly 18 is shown without the ring supports 74. Without the use of the ring supports 74, the forces 94 of the reciprocating members 44 that are associated with the expanding volume chambers 56 may cause the flexible ring 70 to deflect outward between adjacent control pistons 72 creating a bulge or deformation 110 in the shape of the flexible ring 70. This bulge or deformation 110 results in increased stresses in the flexible ring 70 and can result in premature failure of the flexible ring 70.

Referring again to FIGS. 4 and 5, the ring supports 74 prevent or reduce this bulge or deformation 110 of the flexible ring 70 caused by the forces 94 of the reciprocating members 44 acting on the inner surface 76 of the flexible ring 70 by providing surfaces that support the flexible ring 70 between the control pistons 72.

As the displacement of the variable displacement assembly 18 is increased, the ring supports 74 pivot about the axis 105 of the pivot portions 102 such that at least a portion of the support portions 100 support the flexible ring 70 in the range displacement positions between the maximum displacement position and the relaxed position. The pivoting or rocking motion of the ring supports 74 is potentially advantageous as it allows the ring supports 74 to support the flexible ring 70 through the range of displacement positions without the ring supports 74 having to extend or retract.

In addition to providing support for the flexible ring 70 through the range of displacement positions in order to reduce stress in the flexible ring 70, the ring supports 74 can provide bearing surfaces against which the flexible ring 70 rotates. In this embodiment, the arcuate surface 104 of the support portion 100 includes a surface finish that is adapted for allowing low-friction sliding between the ring support 74 and the flexible ring 70.

Figure 7:
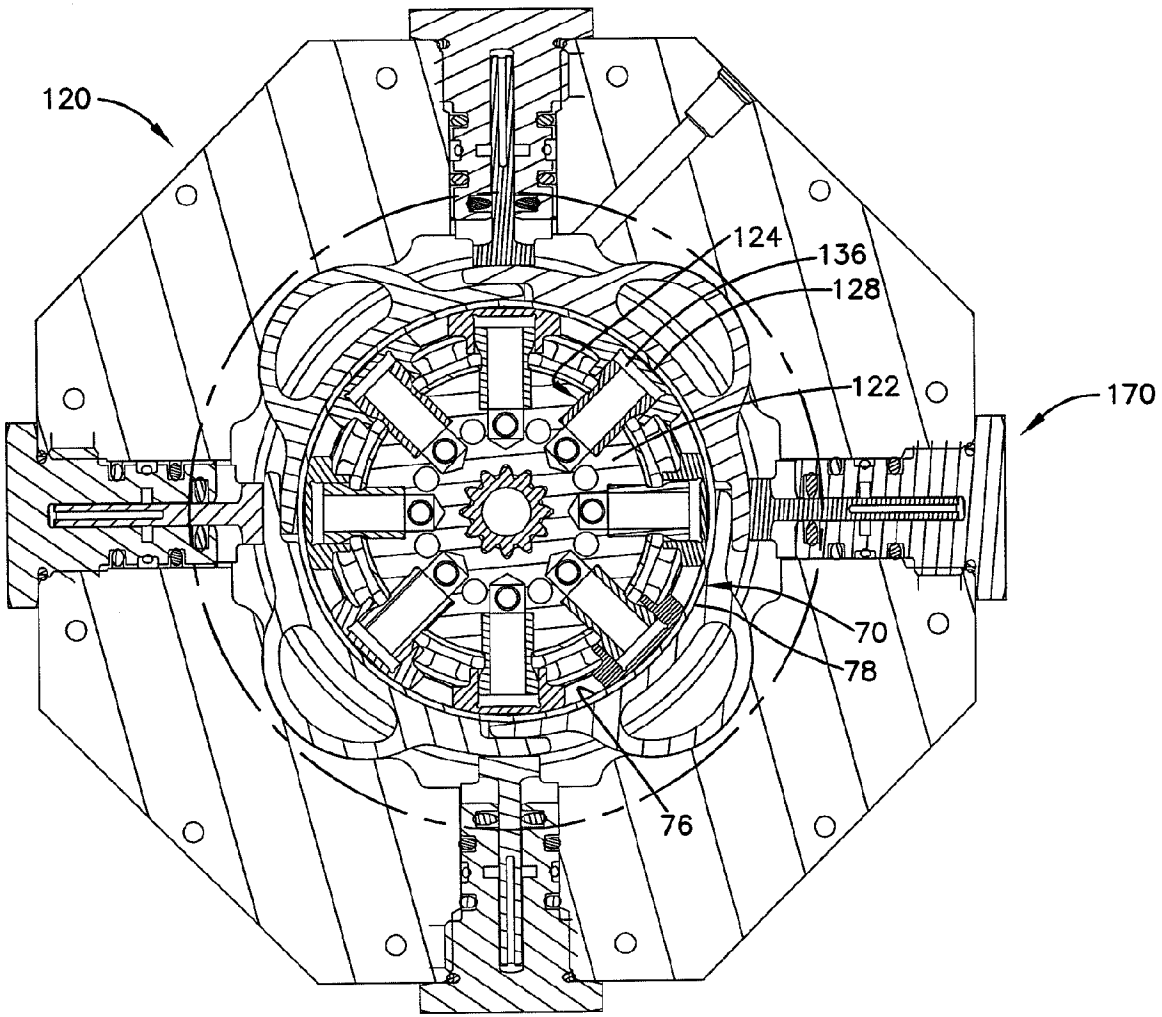
FIG. 7 is a cross-sectional view of an alternate embodiment of a variable displacement assembly suitable for use in the fluid device of FIG. 1.
Figure 8:
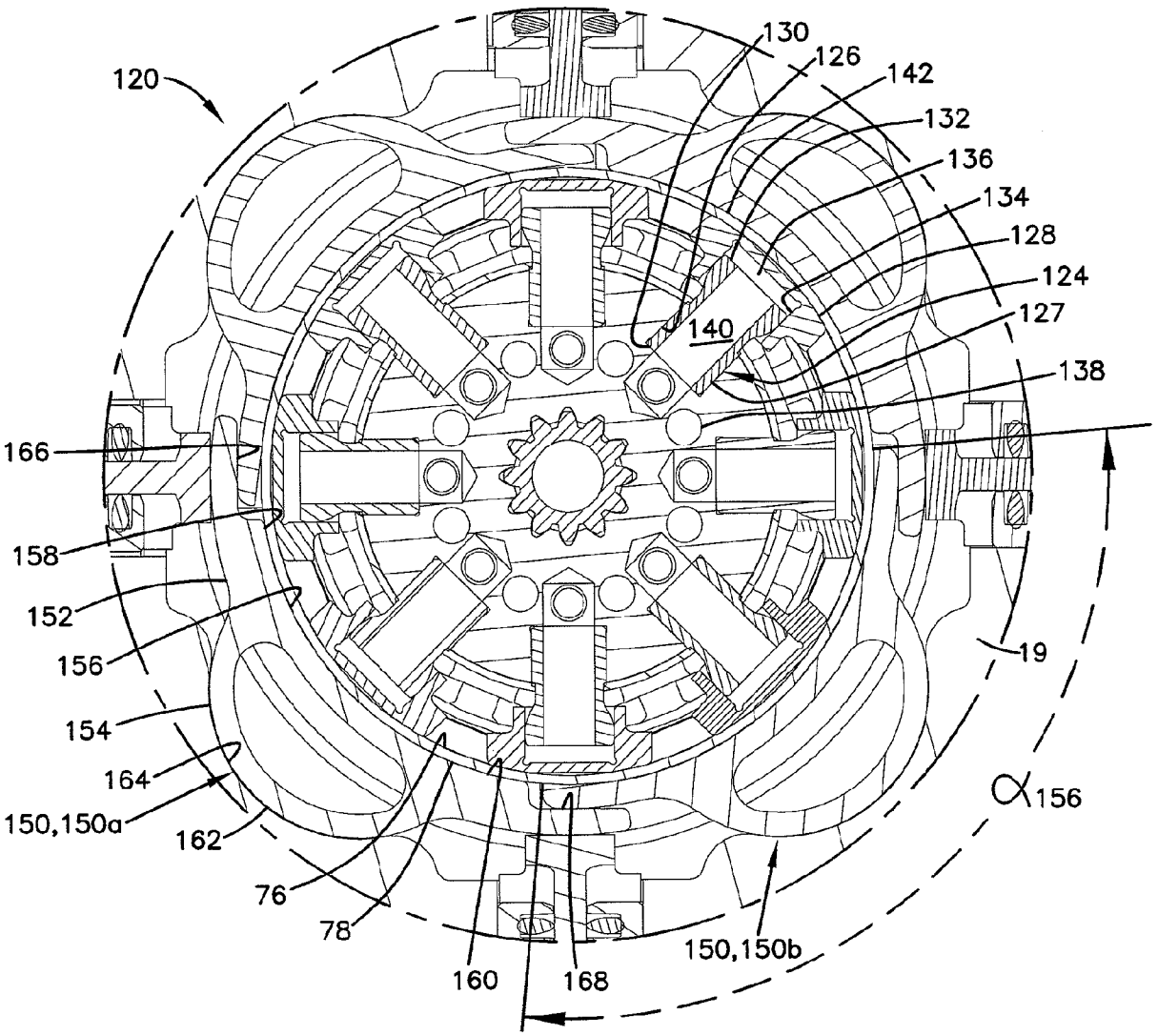
FIG. 8 is an enlarged fragmentary view of the variable displacement assembly of FIG. 7.

Referring now to FIGS. 7 and 8, an alternate embodiment of a variable displacement assembly 120 is shown. In this alternate embodiment, the variable displacement assembly 120 includes a rotor 122 having a plurality of reciprocating members 124. In the subject embodiment, the reciprocating members 124 of the variable displacement assembly 120 are adapted for at least two full reciprocations per rotation of the rotor 122.

In one embodiment, the reciprocating members 124 include piston members 127 and piston shoes 128 that reciprocate relative to the piston members 127. The piston members 127 include first axial end portions 130 and opposite second axial end portions 132. In the subject embodiment, the first axial end portion 130 of each of the piston members 127 is generally cylindrical in shape and is adapted to be disposed in one of the radial bores 126 of the rotor 122. The second axial end portion 132 of each of the piston members 127 is generally partially spherical in shape and is adapted for reciprocating engagement with one of the piston shoes 128. In the subject embodiment, an area of an end of the first axial end portion 130 is less than an area of an end of the second axial end portion 132. This difference in areas between the ends of the first and second axial end portions 130, 132 biases the piston members 127 toward the radial bore 122.

In the subject embodiment, each of the piston shoes 128 is generally cup-shaped and defines a cavity 134 in which the second axial end portion 132 of the piston member 127 is disposed. The cavity 134 of each of the piston shoes 128 and the second axial end portion 132 of each of the piston members 127 cooperatively define a volume chamber 136. As the rotor 122 rotates, fluid enters and exits the volume chamber 136 through a plurality of fluid passages 138 in the rotor 122 and a passage 140 through the piston member 127. As the fluid enters and exits the volume chamber 136, the volume chamber 136 expands and contracts.

The rotor 122 is disposed in the flexible ring 70 such that the reciprocating members 124 act against the inner surface 76 of the flexible ring 70. In the subject embodiment, an outer surface 142 of each of the piston shoes 128 acts directly against the inner surface 76 of the flexible ring 70. As the rotor 122 rotates within the flexible ring 70, the piston shoes 128 pivot about the second axial end portion 132 of each of the piston members 127 such that the outer surfaces 142 of the piston shoes 128 follow the contour of the inner surface 76 of the flexible ring 70.

The variable displacement assembly 120 includes a plurality of ring supports 150 disposed about the outer surface 78 of the flexible ring 70. In the subject embodiment, the ring supports 150 fully enclose or surround the outer surface 78 of the flexible ring 70 when the flexible ring 70 is in the relaxed position. In another embodiment, the ring supports 150 substantially enclose or surround the outer surface 78 of the flexible ring 70 when the flexible ring 70 is in the displaced position.

Each of the plurality of ring supports 150 includes a support portion 152 and a pivot portion 154. In the subject embodiment, the support portion 152 includes an arcuate surface 156 that is adapted for engagement with the outer surface 78 of the flexible ring 70. The arcuate surface 156 is generally concave and defines a radius $R_{156}$ that is a similar in size to the radius of the flexible ring 70 in the relaxed position.

The arcuate surface 156 of each of the support portions 152 extends an angle $\alpha_{156}$. In the subject embodiment, the angle $\alpha_{156}$ is sized such that the ring supports 150 can pivot about the pivot portion 154 without interfering with the pivoting motion of adjacent ring supports 150. In the subject embodiment, each of the arcuate surfaces 156 of each of the ring supports 150 has an angle $\alpha_{156}$ that is in the range of about 80 degrees to about 110 degrees. In another embodiment, each of the arcuate surfaces 156 of each of the ring supports 150 has an angle $\alpha_{156}$ that is about 90 degrees.

The arcuate surface 156 further includes a first side portion 158 and a second side portion 160. The first side portion 158 is disposed at one end of the arcuate surface 156 along the angle $\alpha_{156}$ while the second side portion 160 is disposed at the other end of the arcuate surface 156 along the angle $\alpha_{156}$.

The pivot portion 154 is disposed opposite the support portion 152. The pivot portions 154 are adapted to provide for pivoting or rocking movement of the ring supports 150. In the subject embodiment, each of the pivot portions 154 includes an axis about which the corresponding ring support 150 pivots. In the subject embodiment, the pivot portion 154 includes a convex surface 162. The convex surface 162 is adapted for sliding engagement in a pocket 164 of a support structure of the variable displacement assembly 120 such as the outer ring 19 of the housing 12.

The plurality of ring supports 150 includes a first plurality of ring supports 150*a* and a second plurality of ring supports 150*b*. In the subject embodiment, each of the first and second pluralities of ring supports 150*a*, 150*b* includes two ring supports.

In the depicted embodiment of FIGS. 7 and 8, the first and second plurality of ring supports 150*a*, 150*b* are alternately disposed about the outer surface 78 of the flexible ring 70 such that at least a portion of each of the first plurality of ring supports 150*a* overlaps at least a portion of each of the second plurality of ring supports 150*b*. In the subject embodiment, the arcuate surface 156 of each of the support portions 152 of the first plurality of ring supports 150*a* includes a first groove 166 disposed on the first side portion 158 of the arcuate surface 156 of the first plurality of ring supports 150*a* and a second groove 168 disposed on the second side portion 160. The first and second grooves 166, 168 are adapted to receive first and second side portions 158, 160 of the second plurality of ring supports 150*b*, respectively.

With the first and second side portions 158, 160 of the second plurality of ring supports 150*b* disposed in the first and second grooves 166, 168 of the first plurality of ring supports 150*a*, the first plurality of ring supports 150*a* overlaps at least a portion of the second plurality of ring supports 150*b*. The overlapping configuration of the first and second pluralities of the ring supports 150*a*, 150*b* allows movement in response to displacement changes to be transferred from the support portion 152 of one ring support 150 to the support portion 152 of an adjacent ring support 150 as the first and second pluralities of ring supports 150*a*, 150*b* pivot.

The displacement of the variable displacement assembly 120 is controlled by at least one actuator 170. In the subject embodiment, the displacement of the variable displacement assembly 120 is controlled by two oppositely disposed actuators 170. In an embodiment in which the fluid device 10 is a bidirectional motor, the variable displacement assembly 120 could be controlled by four actuators 170 disposed about the ring supports 150 in 90 degree increments.

In one embodiment, the actuator 170 is a control piston that extends and retracts in response to pressure of fluid communicated to the control piston. In another embodiment, the actuator 170 is a stepper motor.

In the subject embodiment, the actuator 170 is disposed generally at an interface between the first side portion 158 of the support portion 152*a* of one of the ring supports 150 of the first plurality of ring supports 150*a* and the first side portion 158 of the support portion 152*b* of an adjacent ring support 150 of one of the second plurality of ring supports 150*b*. As the actuator 170 extends, the ring supports 150 pivot about their respective pivot portions 154. The extension of the actuator 170 and the pivoting of the ring supports 150 deflect the flexible ring 70 from the relaxed position to a displaced position.

The overlapping engagement of the first and second plurality of ring supports 150*a*, 150*b* are potentially advantageous as it allows the first and second plurality of ring supports 150*a*, 150*b* to move together. In addition, the overlapping engagement of the first and second plurality of ring supports 150*a*, 150*b* are potentially advantageous as it provides a maximum displacement limit for the flexible ring 70. As the ring supports 150 are interconnected and as the ring supports 150 are only free to pivot about the pivot portions 102, the ring supports 150 will bind with each other if the flexible ring 70 is deflected beyond a given amount. This binding point can serve as the maximum displacement position.

Figure 9:
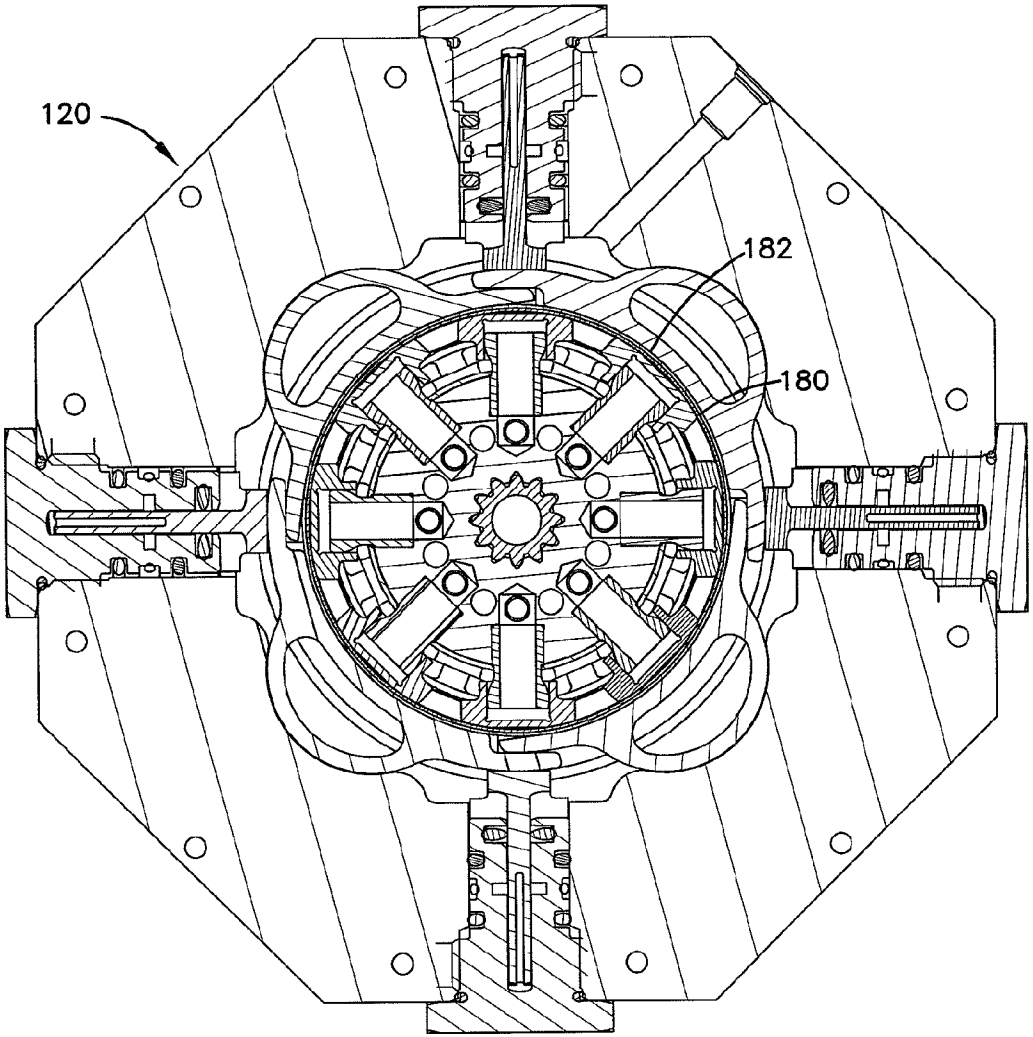
FIG. 9 is a schematic representation of an alternate embodiment of the variable displacement assembly of FIG. 7.
Figure 10:
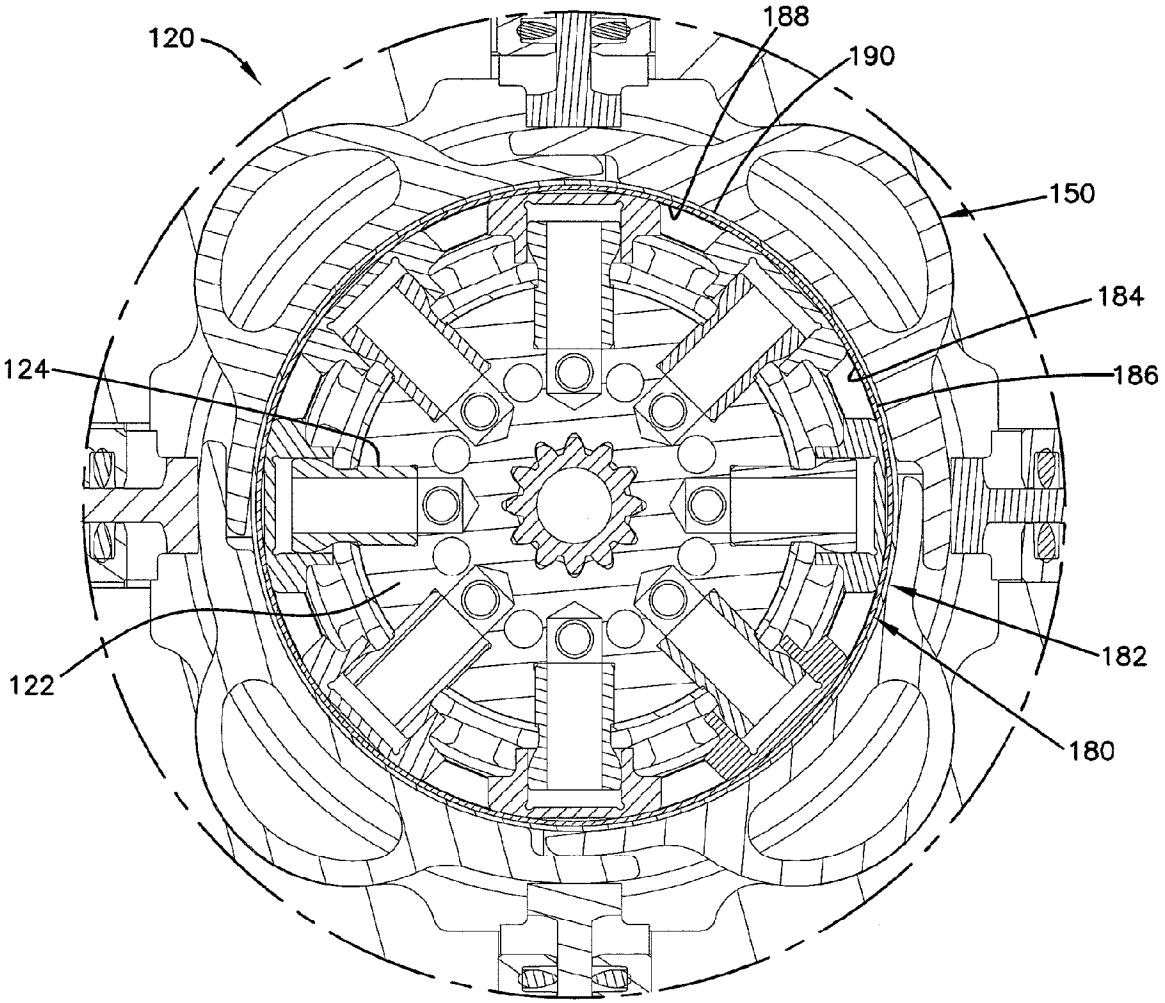
FIG. 10 is an enlarged fragmentary view of the variable displacement assembly of FIG. 9.

Referring now to FIGS. 9 and 10, an alternate embodiment of the variable displacement assembly 120 is shown. In this alternate embodiment, the variable displacement assembly 120 includes an inner flexible ring 180 and an outer flexible ring 182. In the subject embodiment, the inner flexible ring 180 is disposed within the outer flexible ring 182.

The inner and outer flexible rings 180, 182 are thin metal rings that surround the rotor assembly 20. The inner flexible ring 180 is made from a first material to be a first thickness while the outer flexible ring 182 is made from a second material to be a second thickness. In one embodiment, the first material is different than the second material. In one embodiment, and by way of example only, the first material is 6440 grade steel while the second material is made from one of several bronze materials. In another embodiment, the first material is a carbon/graphite material while the second material is a steel or bronze material. In the subject embodiment, the first thickness of the inner flexible ring 180 is about equal to the second thickness of the outer flexible ring 182. By way of example only, each of the first thickness and the second thickness of the inner and outer flexible rings 180, 182 is less than about 0.05 inches.

The inner flexible ring 180 includes an inner surface 184 and an outer surface 186. The inner surface 184 of the inner flexible ring 180 is adapted for engagement with the reciprocating members 124 while the outer surface 186 of the inner flexible ring 180 is adapted for engagement with an inner surface 188 of the outer flexible ring 182. In one embodiment, hydrostatic or hydrodynamic pads are disposed between the outer surface 186 of the inner flexible ring 180 and the inner surface 188 of the outer flexible ring 182. The hydrostatic or hydrodynamic pads between the outer surface 186 of the inner flexible ring 180 and the inner surface 188 of the outer flexible ring 182 can be used to increase the bearing capacity between the inner and outer flexible rings 180, 182.

In the subject embodiment, the inner flexible ring 180 is adapted to rotate in response to the frictional forces between the inner surface 184 of the inner flexible ring 180 and the reciprocating members 124. In one embodiment, the inner flexible ring 180 and the rotor 122 rotate at substantially the same speed.

The plurality of ring supports 150 are overlappingly disposed about an outer surface 190 of the outer flexible ring 182. While the inner flexible ring 180 is adapted to rotate, the outer flexible ring 182 is adapted to be rotationally stationary. As the outer flexible ring 182 is rotational stationary and the inner flexible ring 180 rotates, the interface between the outer surface 186 of the inner flexible ring 180 and the inner surface 188 of the outer flexible ring 182 serves as a bearing surface. The rotationally stationary outer flexible ring 182 is potentially advantageous as it allows the plurality of ring supports 150 to assist in the deflection of the inner and outer flexible rings 180, 182 without having the outer flexible ring rotate against the plurality of ring supports 150.

Figure 11:
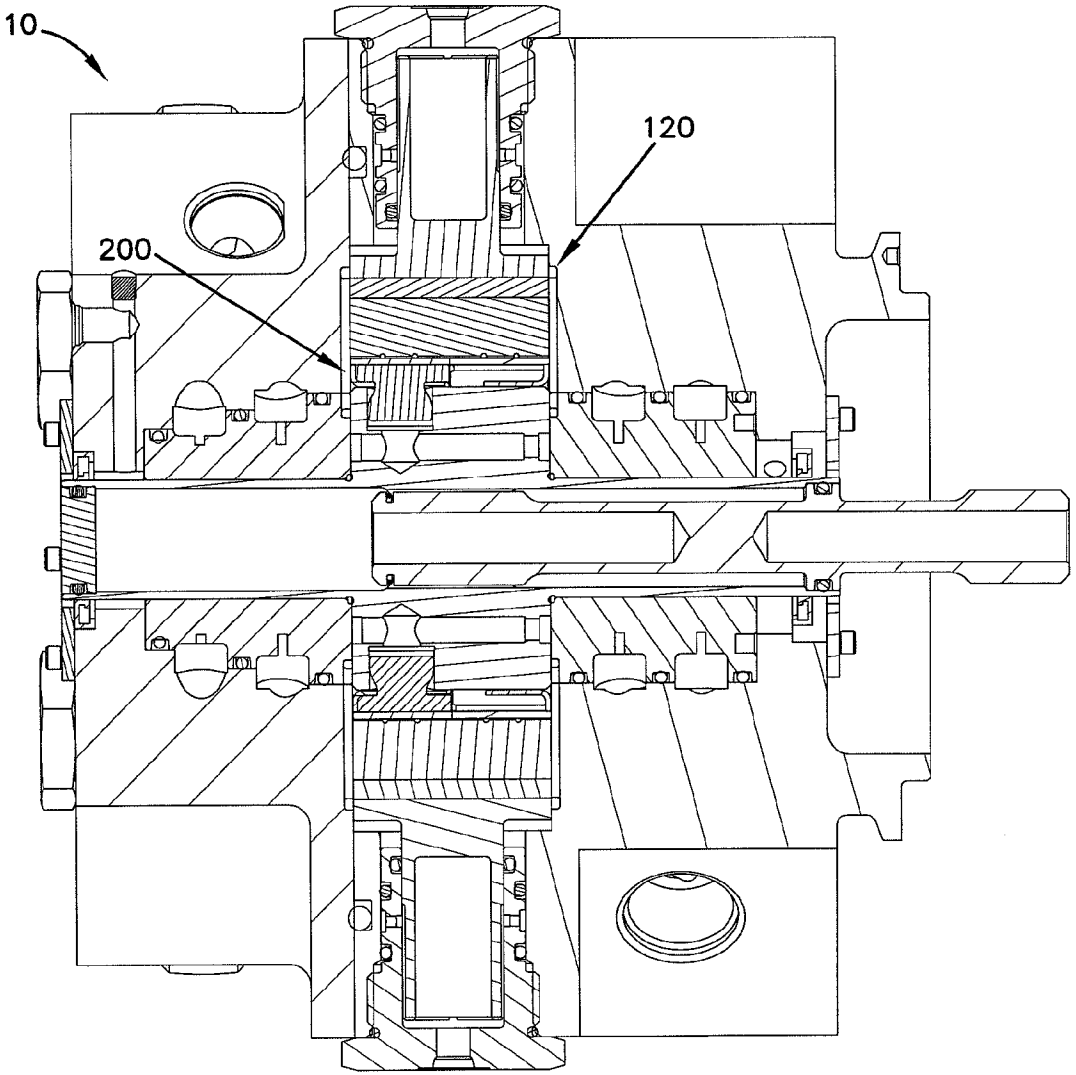
FIG. 11 is a cross-sectional view of the fluid device of FIG. 1 having a variable displacement assembly with an alternate embodiment of reciprocating members.
Figure 12:
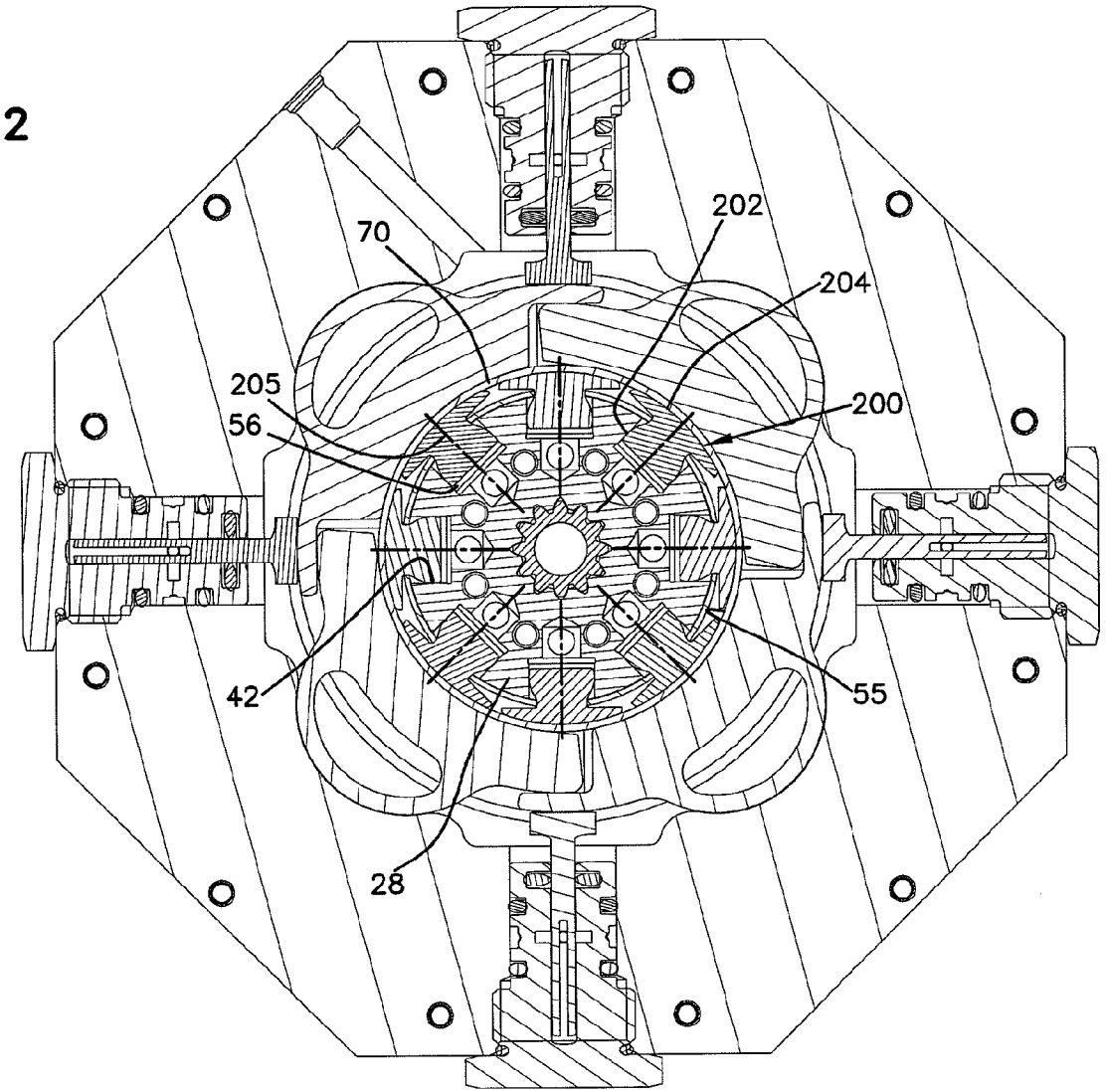
FIG. 12 is a cross-sectional view of the variable displacement assembly of FIG. 11.

Referring now to FIGS. 11-12, the fluid device 10 is shown having the variable displacement assembly 120 with an alternate embodiment of reciprocating members 200. Each of the reciprocating members 200 includes a first axial end portion 202 and an oppositely disposed second axial end portion 204, which is engaged with the cam surface 55 of the variable displacement assembly 120. The first axial end portions 202 are disposed in the bores 42 of the rotor 28. The first axial end portions 202 reciprocate in the bores 42 along longitudinal axes 205 defined by the bores 42 when the flexible ring 70 is disposed in the displaced position such that the reciprocating members 200 extend from and retract in the bores 42.

The bores 42 of the rotor 28 cooperate with the first axial end portions 202 of the reciprocating members 202 to define the volume chambers 56. As the reciprocating members 202 extend from and retract in the bores 42, the volume chambers 56 expand and contract. Fluid flows into the volume chambers 56 as the volume chambers 56 expand and flows out of the volume chambers 56 as the volume chambers 56 contract.

Figure 14:
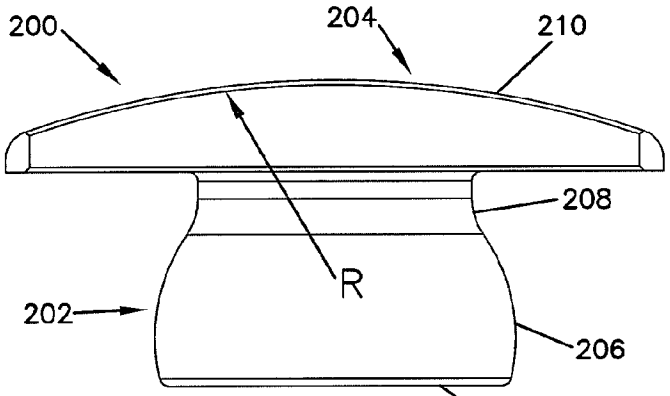
FIG. 14 is a front view of the reciprocating member of FIG. 13.
Figure 15:
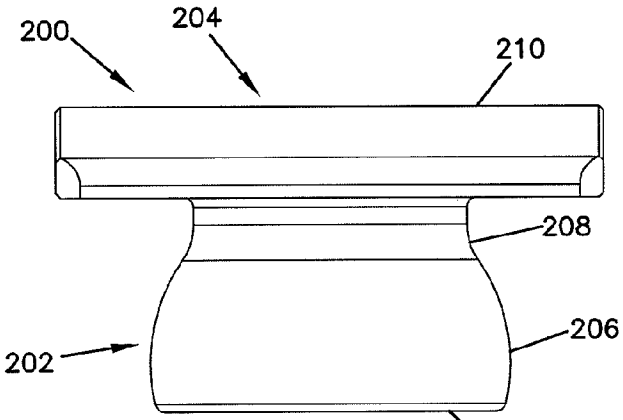
FIG. 15 is a side view of the reciprocating member of FIG. 13.
Figure 13:
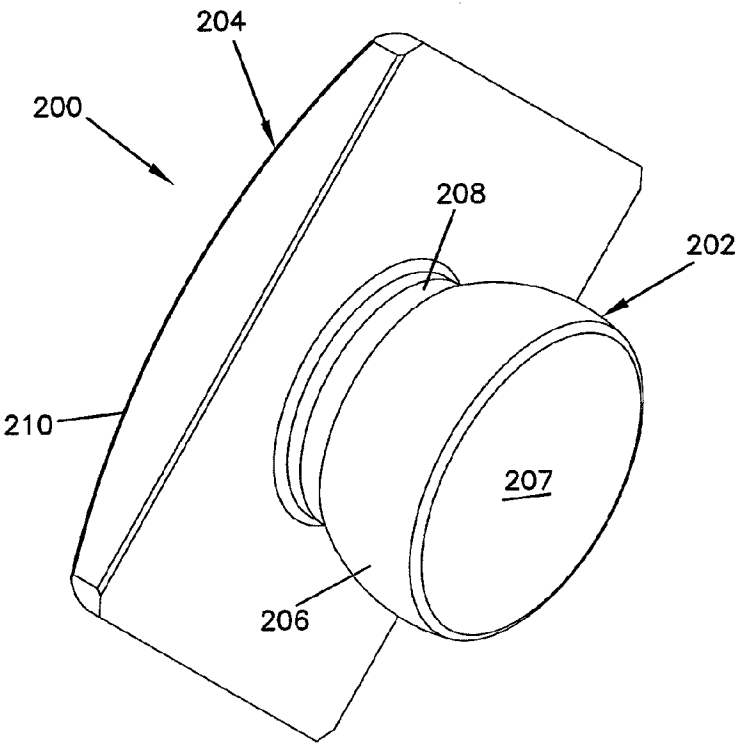
FIG. 13 is a perspective view of a reciprocating member suitable for use in the variable displacement assembly of FIG. 12.

Referring now to FIGS. 13-15, the first axial end portion 202 of the reciprocating member 200 includes a frusto-spherical portion 206. The frusto-spherical portion 206 is adapted for reciprocating engagement in the bore 42 of the rotor 28. The frusto-spherical portion 206 is sized such that its diameter is slightly smaller than the diameter of the bore 42. This slightly smaller diameter allows the reciprocating member 200 to reciprocate in the bore 42 while reducing fluid leakage between the bore 42 and the frusto-spherical portion 206.

The first axial end portion 202 further includes an end surface 207. In the subject embodiment, the end surface 207 is immediately adjacent to the frusto-spherical surface 206. In the depicted embodiment, the end surface 207 is flat surface.

The first axial end portion 202 further includes a neck portion 208. In the subject embodiment, the neck portion 208 joins the frusto-spherical portion 206 of the first axial end portion 202 to the second axial end portion 204 of the reciprocating member 200. The neck portion 208 is sized such that the outer diameter of the neck portion 208 is smaller than the diameter of the frusto-spherical portion 206.

In the subject embodiment, the second axial end portion 204 includes an outer surface 210. The outer surface 210 of the second axial end portion 204 is adapted for engagement with the cam surface 55 of the variable displacement assembly 18. In the depicted embodiment, the outer surface 210 of the second axial end portion 204 defines a length L and a width W. In the subject embodiment, the outer surface 210 is arcuate in shape. In the depicted embodiment, the outer surface 210 defines a radius R along the length L. The radius R is less than or equal to the radius of the cam surface 55 in the relaxed position.

With the first axial end portion 202 and the second axial end portion 204 of each the reciprocating members 200 integrally connected and with the first axial end portion 202 of each of the reciprocating members 200 adapted for reciprocation in the bore 42 of the rotor 28, the reciprocating member 200 can be compact in size. This compactness is potentially advantageous as it allows the outer perimeter of the variable displacement assembly 18 to be smaller. By having a fluid device 10 with a smaller perimeter, the fluid device 10 is capable of being utilized in small spaces.

Figure 16:
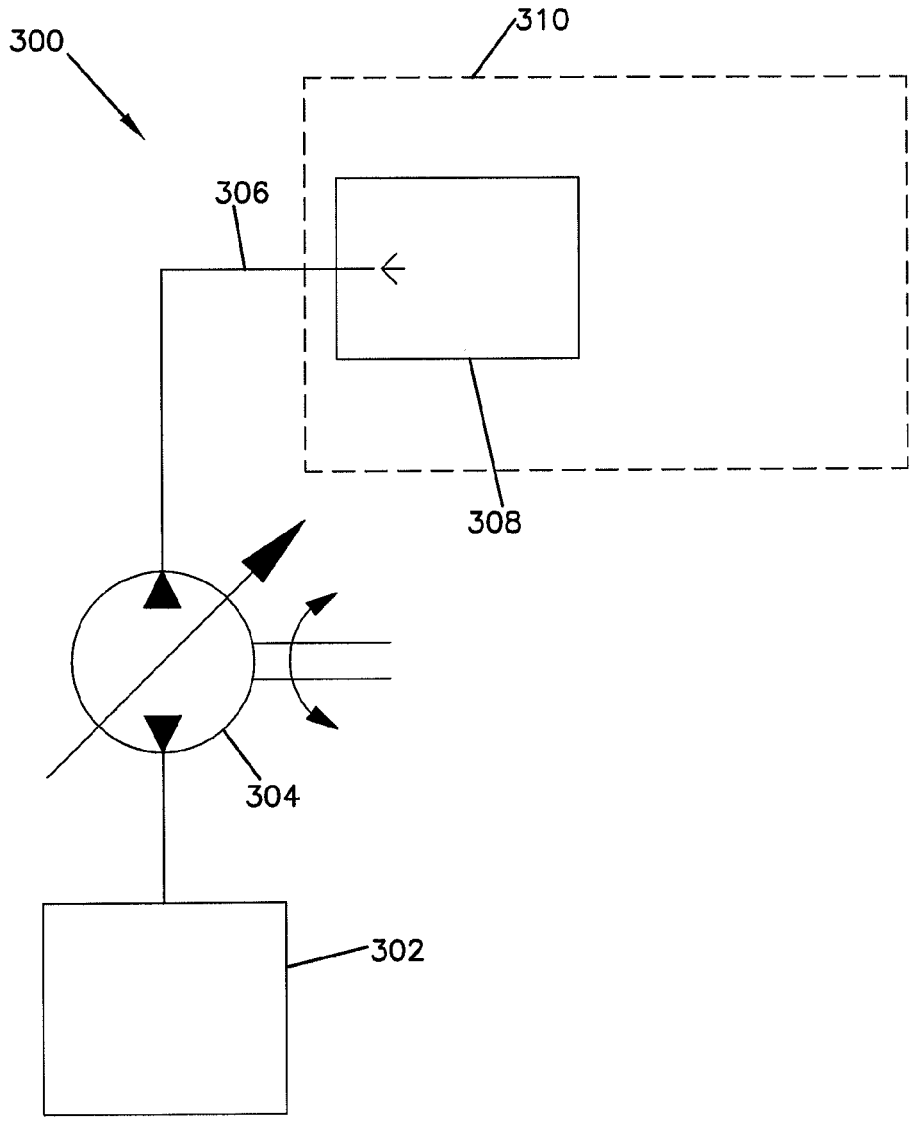
FIG. 16 is a schematic representation of an engine fuel system having features that are examples of aspects in accordance with the principles of the present disclosure.

Referring now to FIG. 16, a schematic representation of an application suitable for the fluid device 10 is shown. In the depicted embodiment of FIG. 8, the application shown is an engine fuel system 300. The engine fuel system 300 of the depicted embodiment is adapted for use in an aerospace application. The engine fuel system 300 includes a fuel source (e.g., fuel tank, fuel reservoir, etc.) 302, a fluid pumping device 304, a fuel manifold 306 and a combustion chamber 308 of an engine 310.

During operation of the engine 310, the fluid pumping device 304 pumps fuel in a first direction from the fuel tank 302 to the fuel manifold 306. At the fuel manifold 306, the fuel is sprayed into the combustion chamber 308 of the engine.

The fluid pumping device 304 is a variable displacement bidirectional fluid pumping device 304. In the subject embodiment, the fluid pumping device 304 is the fluid device 10. As the amount of fuel required by the engine increases, the control pistons 72 of the variable displacement assembly 18 of the fluid device 10 increase the displacement of the flexible ring 70. As the amount of fuel required by the engine decreases, the variable orifices 98 open causing the control pistons 72 to decrease the displacement of the flexible ring 70.

When the engine stops, the fluid device 10 pumps fuel in a second direction that is opposite the first direction. In the second direction, the fuel is evacuated from the fuel manifold and pumped back to the fuel tank 302.

While the change in pumping direction from the first direction to the second direction could be accomplished by changing the direction of rotation of an input shaft to the fluid pumping device 304, in the subject embodiment, the change is accomplished by changing which control pistons 72 are actuated. For example, in FIG. 7, if fuel flows in the first direction when at least one of a first plurality of control pistons 72*a* is activated, the fuel will flow in the second direction when the at least one of the first plurality of control pistons 72*a* is deactivated and at least one of a second plurality of control pistons 72*b* is activated.

In the subject embodiment, with the first plurality of control pistons 72*a* activated or actuated, the flexible ring 70 is displaced into a generally elliptical shape having a major axis. When the second plurality of control pistons 72*b* are actuated, the flexible ring 70 is displaced into a generally elliptical shape having a major axis that is generally perpendicular to the major axis of the first direction. This change in the orientation of major axis of the displaced flexible ring 70 results in the change in pumping direction of the fuel.

Evacuating fuel from the fuel manifold 306 of an engine fuel system 300 can be potentially advantageous. One potential advantage is that it reduces the odor of fuel by the engine 310. Another potential advantage is that it reduces the risk of fuel dripping onto the pavement near airport terminals. By using a fluid pumping device 304 that is capable of bidirectional fluid output, the use of additional valves and/or pumps to accomplish this fuel evacuation can be eliminated thereby reducing the cost and complexity of the engine fuel system 300.

Various modifications and alterations of this disclosure will become apparent to those skilled in the art without departing from the scope and spirit of this disclosure, and it should be understood that the scope of this disclosure is not to be unduly limited to the illustrative embodiments set forth herein.

What is claimed is:

1. A variable displacement assembly for use in a fluid device, the variable fluid displacement assembly comprising:

a flexible ring, the flexible ring having an inner surface and an outer surface;

a plurality of linearly actuated control pistons oppositely disposed from one another about the outer surface of the flexible ring; and a plurality of ring supports disposed about the outer surface of the flexible ring, wherein each of the plurality of ring supports includes a support portion adapted for engagement with the outer surface of the flexible ring and a central pivot portion that defines a central pivot axis about which the ring support selectively pivots, wherein the pivoting of the ring support about the central pivot portion moves the flexible ring between a relaxed position and a displaced position, the central pivot portions being arranged between and in an alternating arrangement with the plurality of control pistons; and the flexible ring being rotatable relative to the ring supports and the support portions of the ring supports providing bearing surfaces against which the flexible ring rotates.

2. A variable displacement assembly for use in a fluid device as claimed in claim 1, further comprising a rotor assembly having a rotor and a plurality of reciprocating members, wherein the reciprocating members are adapted for engagement with the inner surface of the flexible ring.

3. A variable displacement assembly for use in a fluid device as claimed in claim 2, wherein the rotor includes a plurality of bores in which the plurality of reciprocating members is engaged.

4. A variable displacement assembly for use in a fluid device as claimed in claim 3, wherein each of the reciprocating members includes a first axial end portion and an oppositely disposed second axial end portion, the first axial end portions of the reciprocating members being adapted for reciprocation in the bores of the rotor, the second axial end portions of the reciprocating members being adapted for engagement with the inner surface of the flexible ring.

5. A variable displacement assembly for use in a fluid device as claimed in claim 4, wherein the each of the first axial end portions of the reciprocating members includes a frusto-spherical portion.

6. A variable displacement assembly for use in a fluid device as claimed in claim 4, wherein the second axial end portions of the reciprocating members include an outer surface adapted for engagement with the inner surface of the flexible ring, wherein the outer surface is arcuate in shape.

7. A variable displacement assembly for use in a fluid device as claimed in claim 1, wherein the plurality of ring supports includes a first plurality of ring supports and a second plurality of ring supports, wherein the first plurality of ring supports overlappingly engage the second plurality of ring supports.

8. A variable displacement assembly for use in a fluid device as claimed in claim 7, wherein the support portion of each of the plurality of ring supports includes an arcuate surface having a radius that is about equal to a radius of the flexible ring in the relaxed position.

9. A variable displacement assembly for use in a fluid device as claimed in claim 7, further comprising an actuator for selectively displacing the flexible ring, wherein the actuator is disposed at an interface between one of the first plurality of ring supports and one of the second plurality of ring supports.

10. A fluid device comprising a housing defining a fluid inlet and a fluid outlet;

a variable displacement assembly in fluid communication with the fluid inlet and the fluid outlet, the variable displacement assembly including:

a rotor assembly having a rotor and a plurality of reciprocation members;

a flexible ring disposed about the rotor assembly, the flexible ring having an inner surface and an outer surface, wherein the inner surface is adapted for engagement with the plurality of reciprocation members;

a plurality of linearly actuated control pistons oppositely disposed from one another about the outer surface of the flexible ring; and a plurality of ring supports disposed about the flexible ring, wherein each of the ring supports includes a support portion and a central pivot portion that defines a central pivot axis about which the ring support selectively pivots, wherein the support portion being adapted for engagement with the outer surface of the flexible ring, the central pivot portions being arranged between and in an alternating arrangement with the plurality of control pistons; and the flexible ring being rotatable relative to the ring supports and the support portions of the ring supports providing bearing surfaces against which the flexible ring rotates.

11. A fluid device as claimed in claim 10, wherein the variable displacement assembly is of a radial piston type.

12. A fluid device as claimed in claim 10, wherein the rotor includes a plurality of bores in which the plurality of reciprocating members is engaged.

13. A fluid device as claimed in claim 12, wherein each of the reciprocating members includes a first axial end portion and an oppositely disposed second axial end portion, the first axial end portions of the reciprocating members being adapted for reciprocation in the bores of the rotor, the second axial end portions of the reciprocating members being adapted for engagement with the inner surface of the flexible ring.

14. A fluid device as claimed in claim 13, wherein the each of the first axial end portions of the reciprocating members includes a frusto-spherical portion.

15. A fluid device as claimed in claim 13, wherein the second axial end portions of the reciprocating members include an outer surface adapted for engagement with the inner surface of the flexible ring, wherein the outer surface is arcuate in shape.

16. A fluid device as claimed in claim 10, wherein the plurality of control pistons disposed about the outer surface of the flexible ring selectively change the shape of the flexible ring.

17. A fluid device as claimed in claim 16, wherein the plurality of control pistons includes a plurality of displacement pistons and a plurality of reaction pistons, the displacement pistons including a spring and being adapted to receive fluid, wherein the spring and the fluid are adapted to selectively extend the displacement piston and displace the flexible ring to a maximum displacement position.

18. A fluid device as claimed in claim 17, wherein each of the plurality of displacement pistons is in fluid communication with a variable orifice to selectively relieve fluid communicated to the displacement pistons.

19. A fluid device as claimed in claim 16, wherein each of the plurality of control pistons includes a first axial end portion that acts directly against the outer surface of the flexible ring.

20. A fluid device as claimed in claim 16, wherein the pivot portion is disposed in an alternating arrangement between adjacent control pistons.

21. A fluid device comprising:

a housing defining a fluid inlet and a fluid outlet;

a variable displacement assembly in fluid communication with the fluid inlet and the fluid outlet, the variable fluid displacement assembly including:

a rotor assembly having a rotor and a plurality of reciprocation members;

an inner flexible ring disposed about the rotor assembly, the flexible ring having an inner surface and an outer surface, wherein the inner surface is adapted for engagement with the reciprocation members;

an outer flexible ring having an inner surface and an outer surface, wherein the inner surface is adapted for engagement with the outer surface of the inner flexible ring; and a plurality of ring supports disposed about the outer flexible ring, wherein each of the ring supports includes a support portion and a pivot portion about which the ring support selectively pivots, wherein the support portion being adapted for engagement with the outer surface of the outer flexible ring.

22. A fluid device as claimed in claim 21, wherein the inner flexible ring is adapted to rotate and the outer flexible ring is adapted to be rotationally stationary.

23. A fluid device as claimed in claim 22, wherein the inner flexible ring is made of a first material and the outer flexible ring is made of a second material.

24. A fluid device as claimed in claim 23, wherein the first material is different than the second material.

25. A fluid device as claimed in claim 21, wherein the variable displacement assembly is a radial piston type.

26. A fluid device as claimed in claim 21, wherein the plurality of ring supports includes a first plurality of ring supports and a second plurality of ring supports, wherein the first plurality of ring supports overlappingly engage the second plurality of ring supports.

27. A fluid device as claimed in claim 26, further comprising an actuator for selectively displacing the inner and outer flexible rings, wherein the actuator is disposed about the plurality of ring supports at an interface between one of the first plurality of ring supports and one of the second plurality of ring supports.

28. A method for evacuating a fuel manifold of an engine fuel system, the method comprising:

providing a bidirectional fluid device having a variable displacement assembly that is adapted to transfer fuel through the fluid device from a fuel source to a fuel manifold in a first direction, wherein the fuel is transferred in a first direction due to actuation of a first set of control pistons within the variable displacement assembly;

actuating the variable displacement assembly of the fluid device such that the fuel is transferred through the fluid device in a second direction that is opposite from the first direction, wherein actuating the variable displacement assembly comprises actuating a second set of control pistons within the variable displacement assembly; wherein in the second direction the fuel is transferred from the fuel manifold to the fuel source, wherein the variable displacement assembly includes:

a flexible ring, the flexible ring having an inner surface and an outer surface, wherein the first and second set of control pistons are disposed around the outer surface of the flexible ring; and a plurality of ring supports disposed about and surrounding the outer surface of the flexible ring, wherein each of the plurality of ring supports includes a support portion and a pivot portion about which the ring support selectively pivots, wherein the support portion is adapted for engagement with the outer surface of the flexible ring.

* * * * *